US006314997B1

(12) United States Patent
Yamashita

(10) Patent No.: US 6,314,997 B1
(45) Date of Patent: Nov. 13, 2001

(54) MULTIPLE VALVE APPARATUS

(75) Inventor: Shigeru Yamashita, Ohtsu (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 09/564,869

(22) Filed: May 4, 2000

(30) Foreign Application Priority Data

May 21, 1999 (JP) ..... 11-142463
Sep. 30, 1999 (JP) ..... 11-278083

(51) Int. Cl.[7] ..... F15B 13/08

(52) U.S. Cl. ..... 137/596.13; 137/884; 60/452; 60/420

(58) Field of Search ..... 137/596.13, 884; 60/452, 422, 420

(56) References Cited

U.S. PATENT DOCUMENTS 5,203,678 * 4/1993 Sugiyama et al. ..... 137/596.13 X
5,735,305 * 4/1998 Ikei et al. ..... 137/596.13 X
6,089,248 * 7/2000 Rost ..... 137/596.13 X
6,098,403 * 8/2000 Wilke ..... 60/452 X

* cited by examiner

*Primary Examiner*—Kevin Lee
(74) *Attorney, Agent, or Firm*—Kanesaka & Takeuchi

(57) ABSTRACT

A multiple valve apparatus is formed of a priority valve mechanism for dividing an operating liquid into a priority flow and a surplus flow, at least one switching valve mechanism attached to the priority valve mechanism, a parallel line for guiding the surplus flow discharged from the priority valve mechanism to an input port of the at least one switching valve mechanism, a tank line for discharging the operating liquid to a tank, and an urgent valve situated between the parallel line and the tank line. The urgent valve is operated in a predetermined condition to regulate an operation actuated by the surplus flow through the at least one switching valve mechanism. Therefore, the supply of the operating fluid only to the switching mechanism can be stopped or regulated by this simple structure, and an automatic stop or regulating function of an actuator can be achieved in the apparatus.

8 Claims, 7 Drawing Sheets

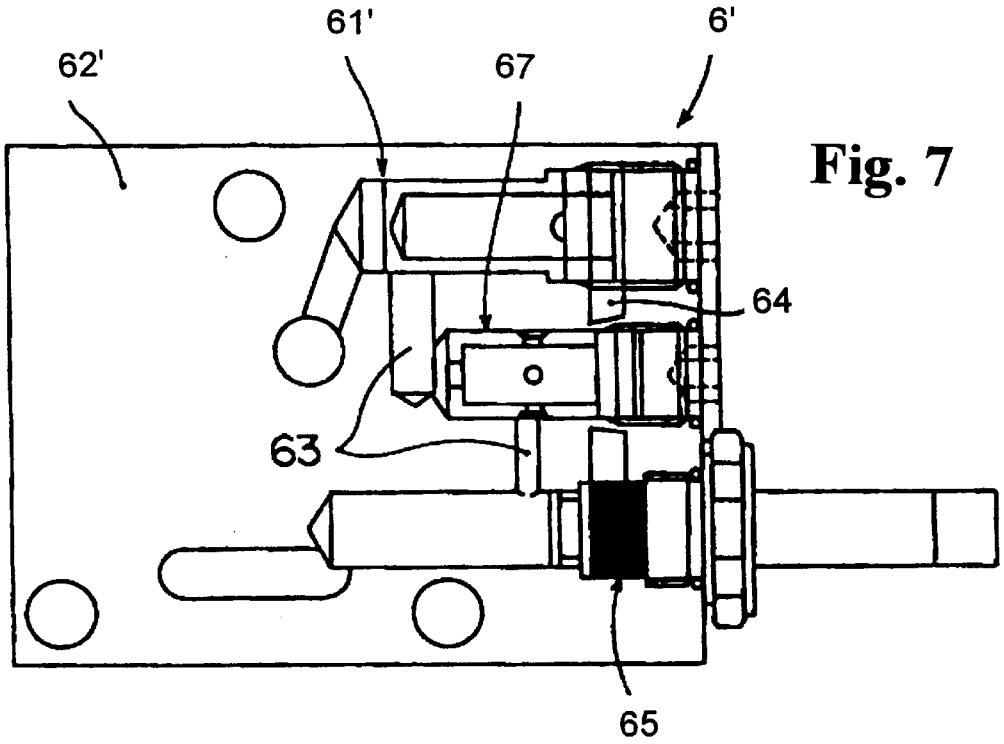
Fig. 7
Fig. 8
Prior Art
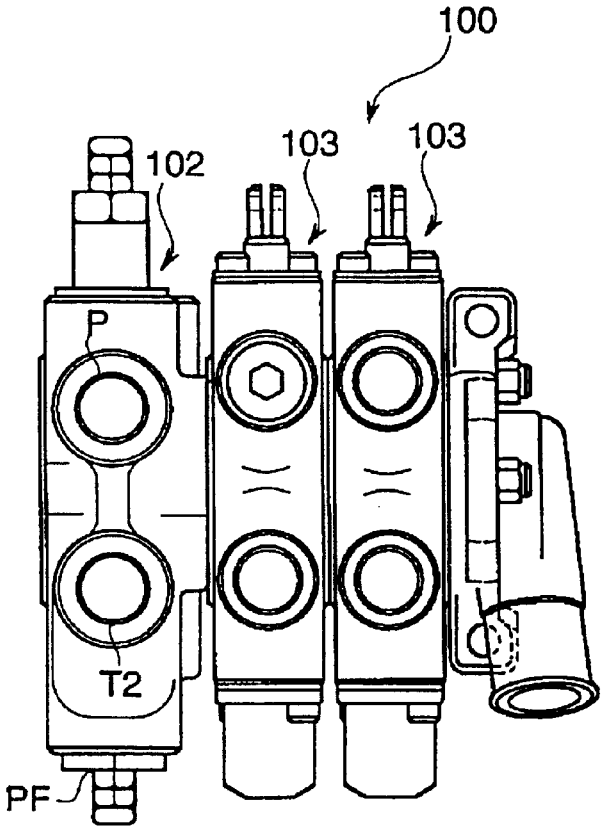

MULTIPLE VALVE APPARATUS

BACKGROUND OF THE INVENTION AND RELATED ART STATEMENT

The present invention relates to a multiple valve apparatus which is preferably used for an industrial vehicle, such as a forklift truck, wherein a plurality of switching valve mechanisms can be stacked or attached together.

As a conventional multiple valve apparatus 100 of this kind, as shown in FIG. 8, there has been known a multiple valve apparatus which includes a priority valve mechanism 102 and a plurality of switching valve mechanisms 103 disposed on a downstream of the priority valve mechanism 102. In this multiple valve apparatus, as shown in FIG. 9, a high pressure operating oil discharged from a hydraulic pump, not shown, is received at a port P, and for example, a flow of the high pressure oil is divided by the priority valve mechanism 102, which is a constituent of the multiple valve apparatus, to a primarily flow ejected at a port PF for a steering operation, and a surplus flow thereof is guided through a parallel line 104 to reach input ports 132 of switching valves 131 built in the switching valve mechanisms 103. And, the switching valves 131 are manually operated by operating levers L, so that an actuator, such as a tilt cylinder TS, a lift cylinder LS or the like, can be driven by the aforementioned surplus flow.

On the other hand, in the forklift truck in recent years, as an added value, there have been required an automatic horizontal stop function in which a mast can be automatically stopped in a horizontal condition, and an automatic elevation stop function in which the mast is stopped at a predetermined height. Also, in the forklift truck in recent years, in order to prevent collapse of loads or overturn of the vehicle, there has been proposed a function for limiting an operation speed of the actuator in a load condition in which it is moved near a stroke end or in which a balance of the vehicle is liable to be lost.

However, in regard to these demands, it has been considered that the multiple valve apparatus with the manually operated conventional type can not be adopted. Thus, there has been developed a multiple valve apparatus with an automatically operated type by using an electromagnetic proportional valve in the switching valve mechanism.

However, these devices are of high grade, and have a disadvantage in the aspect of a cost thereof. Also, simply, there has been considered a method of unloading the discharge oil from the pump completely before the discharge oil is guided to the multiple valve apparatus. However, in this method, since the function of the priority valve mechanism is stopped while the automatic stop function is operated, there is caused an inconvenience such that a supply of the high pressure operating oil to the steering or the like is cut off.

The present invention has been made in order to solve these problems, and in view of the fact that a supply of the operating oil to each switching valve mechanism is operated through the parallel line communicating with a supply flow output port of the priority valve mechanism, and a main object of the invention is to provide a multiple valve apparatus which is provided with an urgent stop valve which is capable of disconnecting and connecting between the parallel line and a tank line, wherein in a predetermined condition where the automatic stop function is required, the urgent stop valve is opened to allow the supply of the operating oil only to the switching valve mechanism to eject by a simply structure, so that the automatic stop function for the actuator, such as a cylinder, can be achieved.

Another object of the invention is to provide a multiple valve apparatus, wherein a supply of the operating oil only to the switching valve mechanism is limited also by the simple structure, so that an automatic deceleration of the actuator, such as a cylinder, can be achieved.

Further objects and advantages of the invention will be apparent from the following description of the invention.

SUMMARY OF THE INVENTION

To achieve the aforementioned objects, the present invention provides a multiple valve apparatus, which is formed of a priority valve mechanism for dividing a supplied operating liquid into a priority flow and a surplus flow and discharging the same; one or a plurality of switching valve mechanisms including a switching valve therein and being stacked on the priority valve mechanism; a parallel line for guiding the surplus flow discharged from the priority valve mechanism to each input port of each switching valve, and an urgent stop valve for communicating the parallel line with a tank line in a predetermined condition.

Also, in the multiple valve apparatus of the invention, a supplied operating fluid is divided by the priority valve mechanism into the priority flow and the surplus flow, and the surplus flow discharged from the priority valve mechanism is guided to input ports of switching valves built in one or plural switching mechanisms. The multiple valve apparatus as structured above is provided with an urgent valve formed between the parallel line and the tank line communicating with the tank, and by opening the urgent valve, the parallel line is allowed to communicate with the tank line through a flow amount control valve disposed on the downstream side of the urgent valve.

In this multiple valve apparatus, without deteriorating or losing the function of the priority valve mechanism, and without using the high-grade and expensive member, such as electromagnetic proportional valve, an automatic stop function or automatic deceleration function of the actuator, which is necessary for a forklift truck or the like, can be achieved by a simple and inexpensive structure, such as interposing the urgent stop valve or the urgent valve in the parallel line.

The aforementioned predetermined condition is set in accordance with a horizontal position or an elevated position in the industrial vehicle, for example a forklift truck, and generally obtained by the condition detecting means, such as position sensor. However, in order to correspond to these structures optimally and to simplify the structure, it is preferable that the urgent stop valve or urgent valve is electromagnetically driven by the information form the condition detecting means.

Also, by simply adding an urgent stop valve block or urgent valve block to the existing multiple valve apparatus, the present invention can be achieved easily and at an extremely low cost. In order to obtain various effects such as introducing the apparatus to the users, it is preferable that the urgent stop valve or urgent valve is accommodated in the urgent valve block having the attachment compatibility with the switching valve mechanism.

BRIEF DESCRIPTION OF THE DRAWINGS

FIG. 7 is a schematic sectional view showing an inner structure of an urgent valve block in the second embodiment;

FIG. 8 is a side view showing a conventional multiple valve apparatus; and

DETAILED DESCRIPTION OF PREFERRED EMBODIMENTS

Hereinafter, a first embodiment of the invention will be explained with reference to the accompanying drawings.

Figure 1:
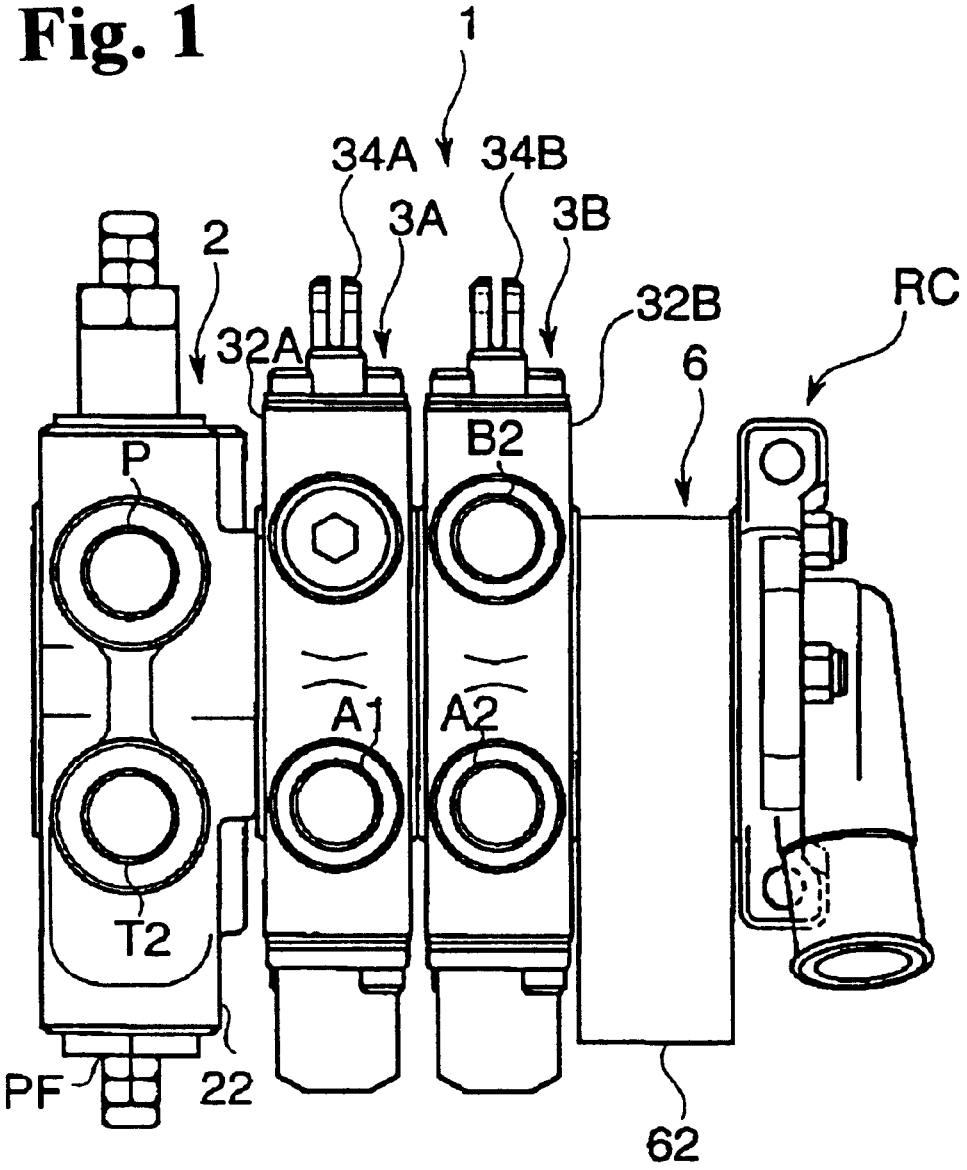
FIG. 1 is a side view showing a multiple valve apparatus according to a first embodiment of the invention.
Figure 2:
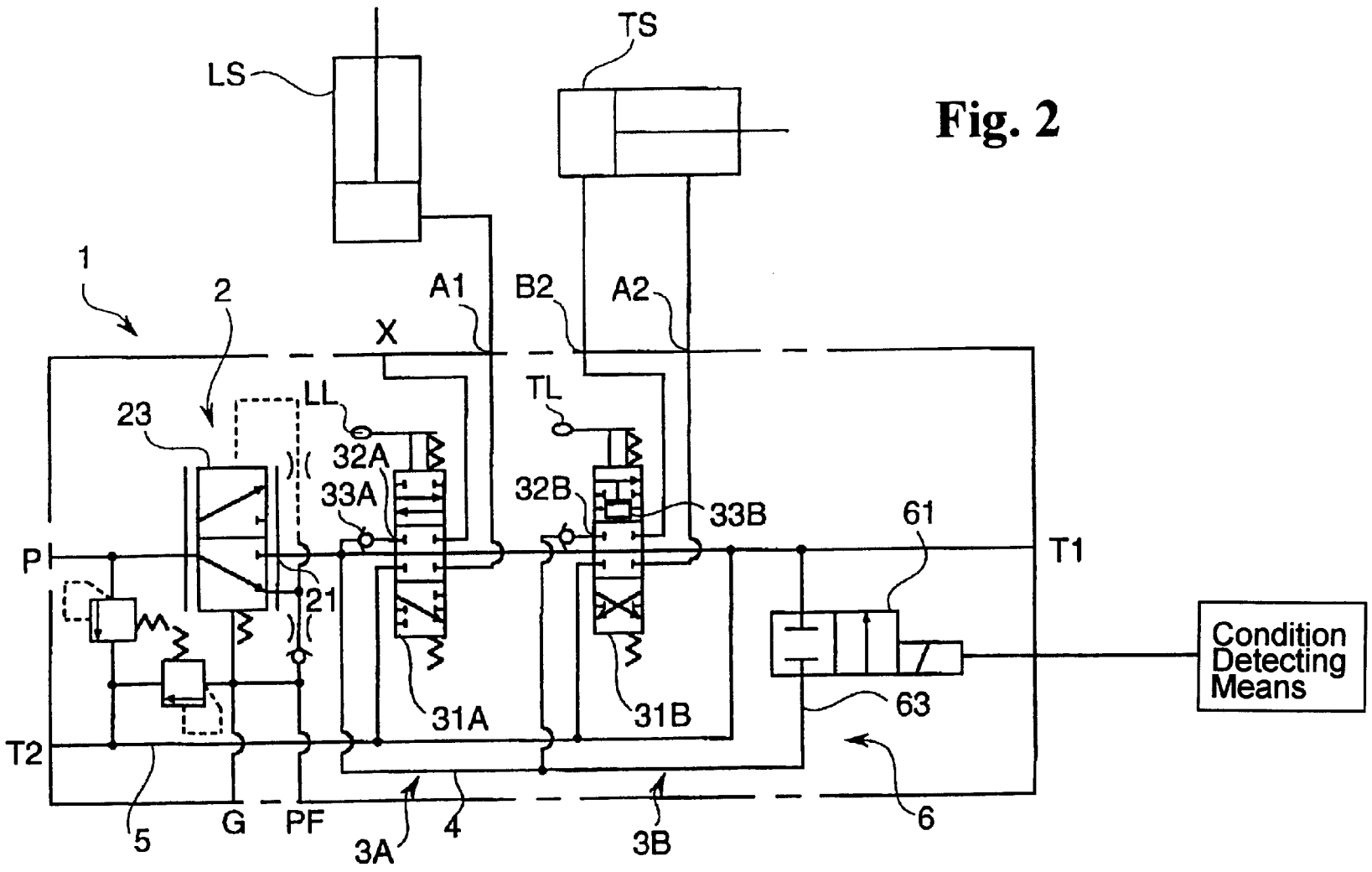
FIG. 2 is a circuit diagram for oil pressure in the multiple valve apparatus of the first embodiment.

A multiple valve apparatus 1 according to the first embodiment of the invention is, for example, of a multi-stack system installed in a forklift truck F as shown in FIG. 1 and FIG. 2, and includes a priority valve mechanism 2, two switching valve mechanisms 3A and 3B stacked or attached to a downstream of the priority valve mechanism 2, and an urgent stop valve block 6 in which an urgent stop valve 61 is built.

Figure 5:
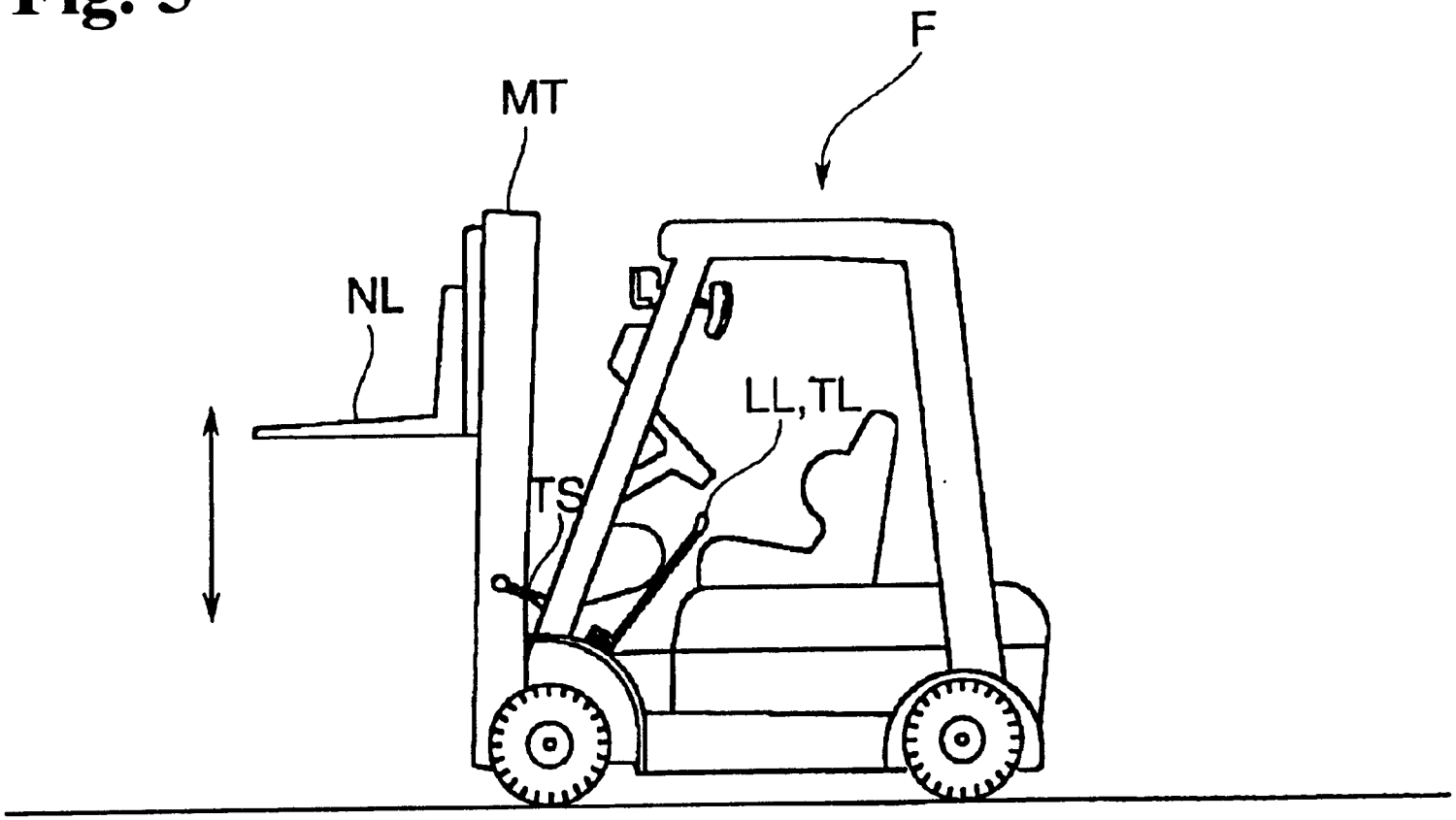
FIG. 5 is an entire side view showing a forklift in the first embodiment.

The forklift truck F is a known device which is self-mobile type as shown in FIG. 5, and has a function at least such that by an operation of a lift lever LL, a lift cylinder LS (shown in FIG. 2) is driven to move a claw or fork NL vertically or up and down, and by an operation of a tilt lever TL, a tilt cylinder TS is driven to incline a mast MT in the front and rear directions. Further, in this embodiment, first condition detecting means, not shown, such as a proximity switch, which can detect a condition such that the claw NL is horizontal, is attached to, for example, the tilt cylinder TS, and second condition detection means, not shown, such as a proximity switch, which can detect that the claw NL is located at a position higher than the predetermined height, is attached to, for example, the lift cylinder LS.

The priority valve mechanism 2 is structured such that various kinds of valves, such as a priority valve main body 23 or the like, are integrally assembled into a main body 22 which includes hydraulic paths therein, and has a priority flow dividing function for dividing a flow of the supplied operating liquid into a priority flow and a surplus flow. The priority valve mechanism 2 includes a port P as an inlet for high pressure operating oil discharged from a hydraulic pump, not shown; a tank port T2 communicating with a tank, not shown; and a port PF which communicates with a steering operation auxiliary circuit, not shown, and primarily discharges the operating oil necessary at the time of steering operation.

The switching valve mechanisms 3A and 3B are formed such that switching valves 31A and 31B in a three-input and three-output system are integrally assembled into valve sections 32A and 32B including hydraulic paths therein. One of the switching valve mechanisms, that is, the switching valve mechanism 3A, includes an output port A1 connected to the lift cylinder LS. In the switching valve 31A, the lift lever LL is mechanically connected to an operation end portion 34A thereof, and inner paths are changed by a manual operation of the lift lever LL to project and retreat the lift cylinder LS. The other switching mechanism 3B includes two output ports A2 and B2 respectively connected to the tilt cylinder TS. In the switching valve 31B, the tilt lever TL is mechanically connected to an operation end portion 34B thereof, and inner paths are switched by a manual operation of the tilt lever TL to project or retreat the tilt cylinder TS. In this embodiment, as shown in FIG. 1, the switching mechanisms 3A and 3B are laminated and stacked on the priority valve mechanism 2. Incidentally, in accordance with a number of actuators, such as cylinders, three or more switching valve mechanisms 3A and 3B can be attached.

Figure 3:
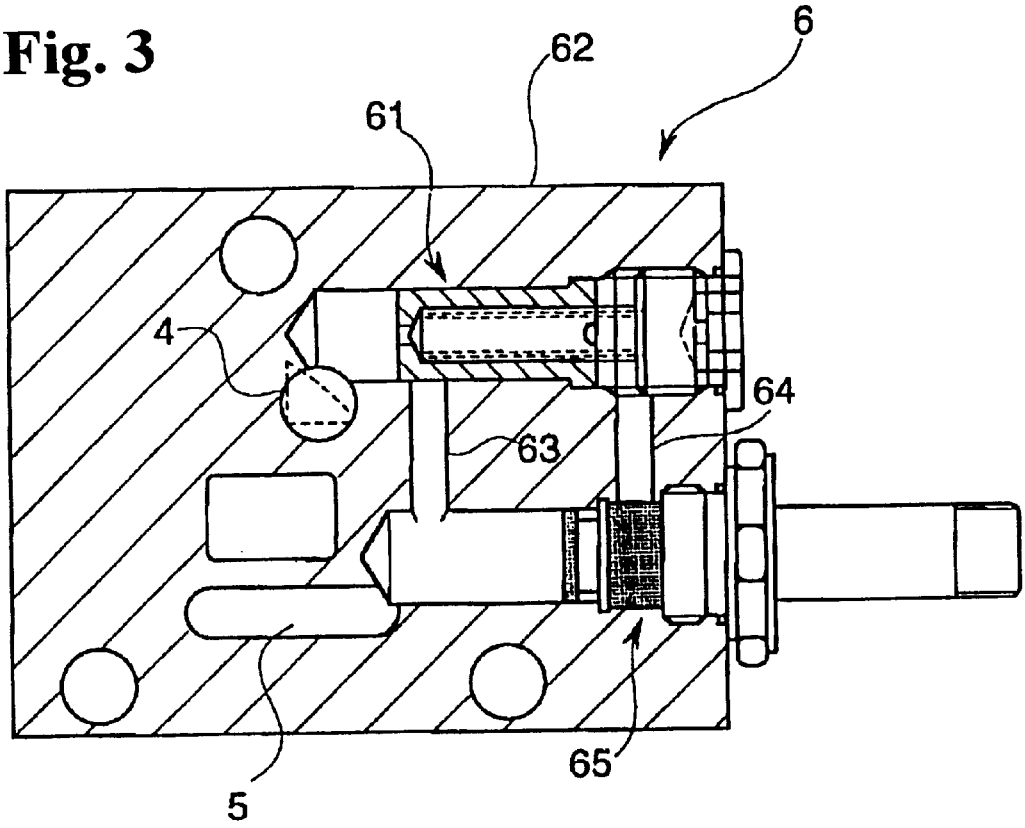
FIG. 3 is a schematic sectional view showing an inner structure of an urgent stop valve block in the first embodiment.
Figure 4:
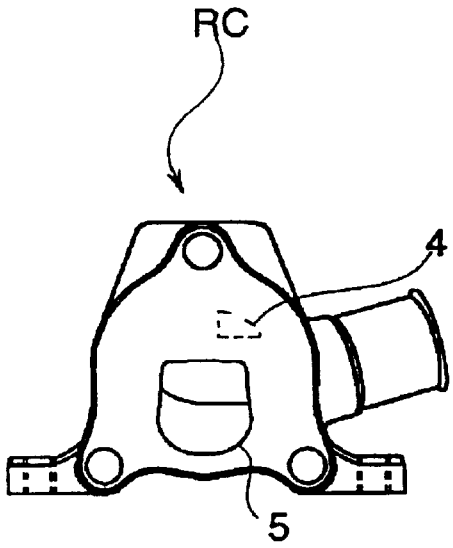
FIG. 4 is a front view of a rear cover in the first embodiment.

As especially shown in FIG. 3, the urgent stop valve block 6 is structured such that an urgent stop valve 61 or the like is integrally assembled into a manifold block 62 in which hydraulic paths are formed, and has an attachment compatibility with the switching valve mechanisms 3A and 3B. The urgent stop valve 61 is a balance piston valve of a pilot operate type, and is disposed on an unload path 63 which allows a hydraulic path constituting a tank line 5 to communicate with a hydraulic path constituting a parallel line 4 among the inner hydraulic paths of the urgent stop valve block 6. And, it is structured such that the urgent stop valve 61 is opened when an electromagnetic valve 65 formed on a pilot path 64 is opened. The electromagnetic valve 65 is opened or closed by a signal from the aforementioned first and second condition detecting means. In this embodiment, as shown in FIG. 1, the urgent stop valve block 6 is stacked outside of the switching valve mechanism 3B located at the most downstream or lowest stream side. Further, outside the urgent stop valve block 6, a rear cover RC shown in FIGS. 1 and 4 is attached.

A structure of an inner hydraulic circuit of the multiple valve apparatus 1 formed by stacking the switching valve mechanisms 3A and 3B or the like as described above will be explained as follows.

A surplus flow from the priority valve mechanism 2 is discharged from a surplus flow output port 21 of the priority valve main body 23, and through the parallel line 4 formed by stacking the switching mechanisms 3A and 3B, the surplus flow output port 21 communicates with first input ports 32A and 32B of the switching valves 31A and 31B forming the respective switching valve mechanisms 3A and 3B. Also, by manual switching operations of the switching valves 31A and 31B by the lift lever LL and the tilt lever TL, the first input ports 32A and 32B are allowed to communicate with the lift cylinder LS and the tilt cylinder TS through the respective output ports A1, A2 and B2, so that the lift cylinder LS and the tilt cylinder TS can be driven by the surplus flow thereof. The tank line 5 is formed in the priority valve mechanism 2 and the switching mechanisms 3A, 3B stacked together, and is structured to communicate with the tank port T2 of the priority valve mechanism 2 and the tank port T1 formed in the rear cover TS. The parallel line 4 and the tank line 5 are connected to each other through the unload path 63 formed in the urgent stop valve block 6 as described above, and they are communicated by opening the urgent stop valve 61 formed on the unload path 63 and actuated by condition detecting means.

Next, operations of the multiple valve apparatus 1 according to the present embodiment will be explained.

When the lift cylinder LS is extended or stretched by the operation of the lift lever LL to elevate the claw or fork NL, an output signal of the second condition detecting means is switched at the point when the claw NL reaches the predetermined height, so that the electromagnetic valve 65 is actuated by the condition detecting means to open and the urgent stop valve 61 is opened. As a result, the parallel line 4 is allowed to communicate with the tank line 5, and the operating oil supplied to the lift cylinder LS is unloaded, so that the elevating operation of the claw NL is automatically stopped despite the elevating operation of the lift lever LL. Incidentally, a load check valve 33A is built in the switching valve mechanism 3A, so as to prevent the operating oil in the lift cylinder LS from flowing backward to lower the claw NL. As described above, the automatic elevation stop is achieved in the present embodiment.

On the other hand, while the tilt cylinder TS is being stretched or shrunk by the operation of the tilt lever TL to incline the mast MT in the front or rear direction, when the claw NL becomes horizontal, that is, the mast MT is oriented substantially vertically, the output signal of the first condition detecting means is switched. Accordingly, the electromagnetic valve 65 is actuated to open, and the urgent stop valve 61 is opened. As a result, the parallel line 4 is allowed to communicate with the tank line 5, and the operating oil supplied to the tilt cylinder TS is unloaded, so that the inclined movement of the mast MT in the front or rear direction is automatically stopped despite the operation of the tilt lever TL. Incidentally, a load check valve 33B is built in the switching valve mechanism 3B, so as to prevent the operating oil in the tilt cylinder TS from flowing backward to incline the mast MT forwardly. As described above, the automatic horizontal stop is achieved in the present embodiment.

In the above described operations, in order to operate the elevation stop or the horizontal stop gradually or calmly, a driver or operator can only adjust the operation of the lever in the vicinity of the operations of these aforementioned functions.

Incidentally, for example, a switch for turning on or off the function may be provided in a driver's seat or operator's seat, so that the driver can select one of the conditions, that is, the condition in which the aforementioned automatic elevation stop function or the automatic horizontal stop function can be actuated, and the condition in which these functions are not actuated. More specifically, there may have an electric circuit wherein the output signals from the first and second condition detecting means are validated or invalidated by the operation of the on-off switch.

Hereinafter, a second embodiment of the invention will be explained with reference to the accompanying drawings.

Figure 6:
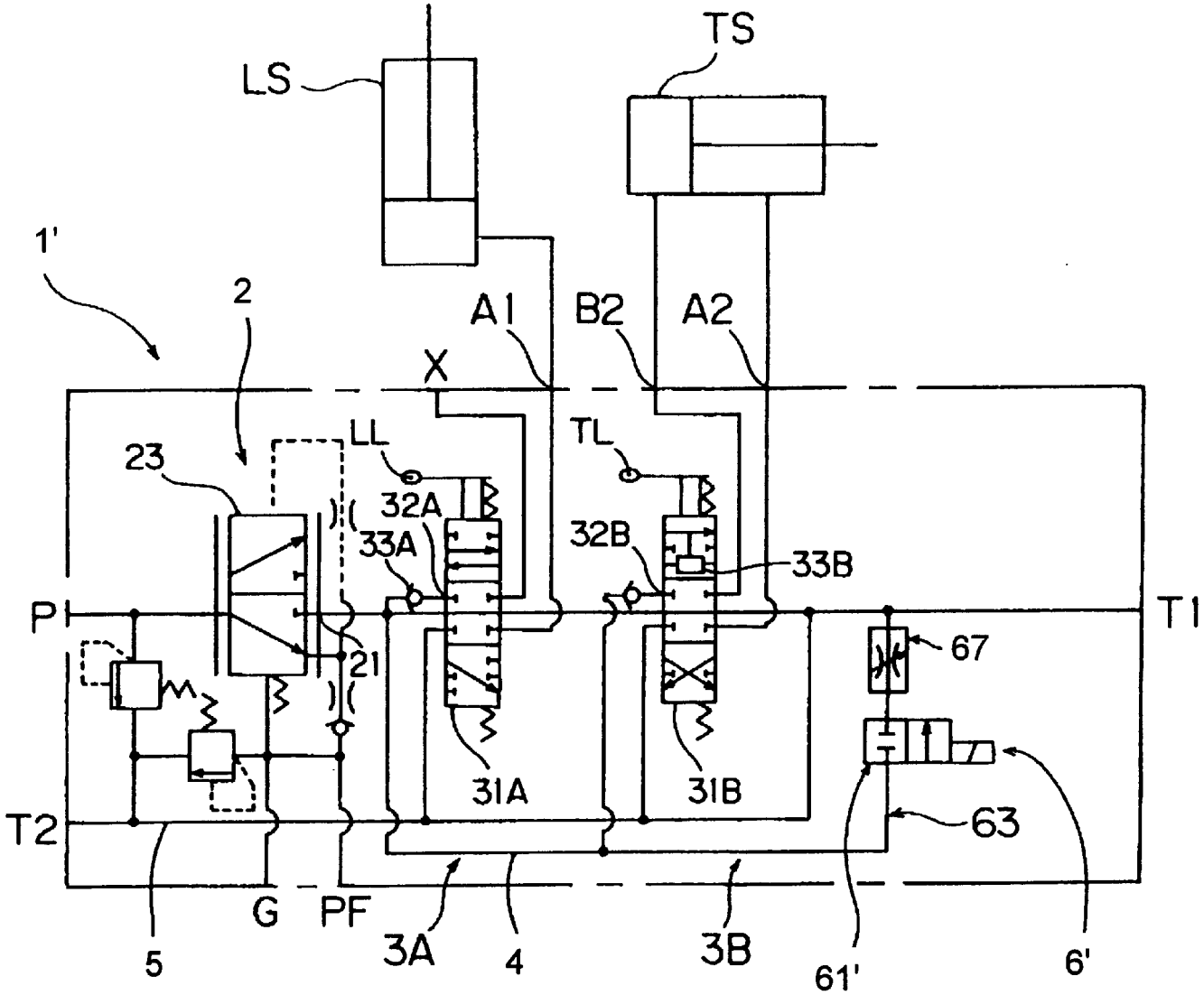
FIG. 6 is a circuit diagram for oil pressure in a multiple valve apparatus according to a second embodiment of the invention.
Figure 9:
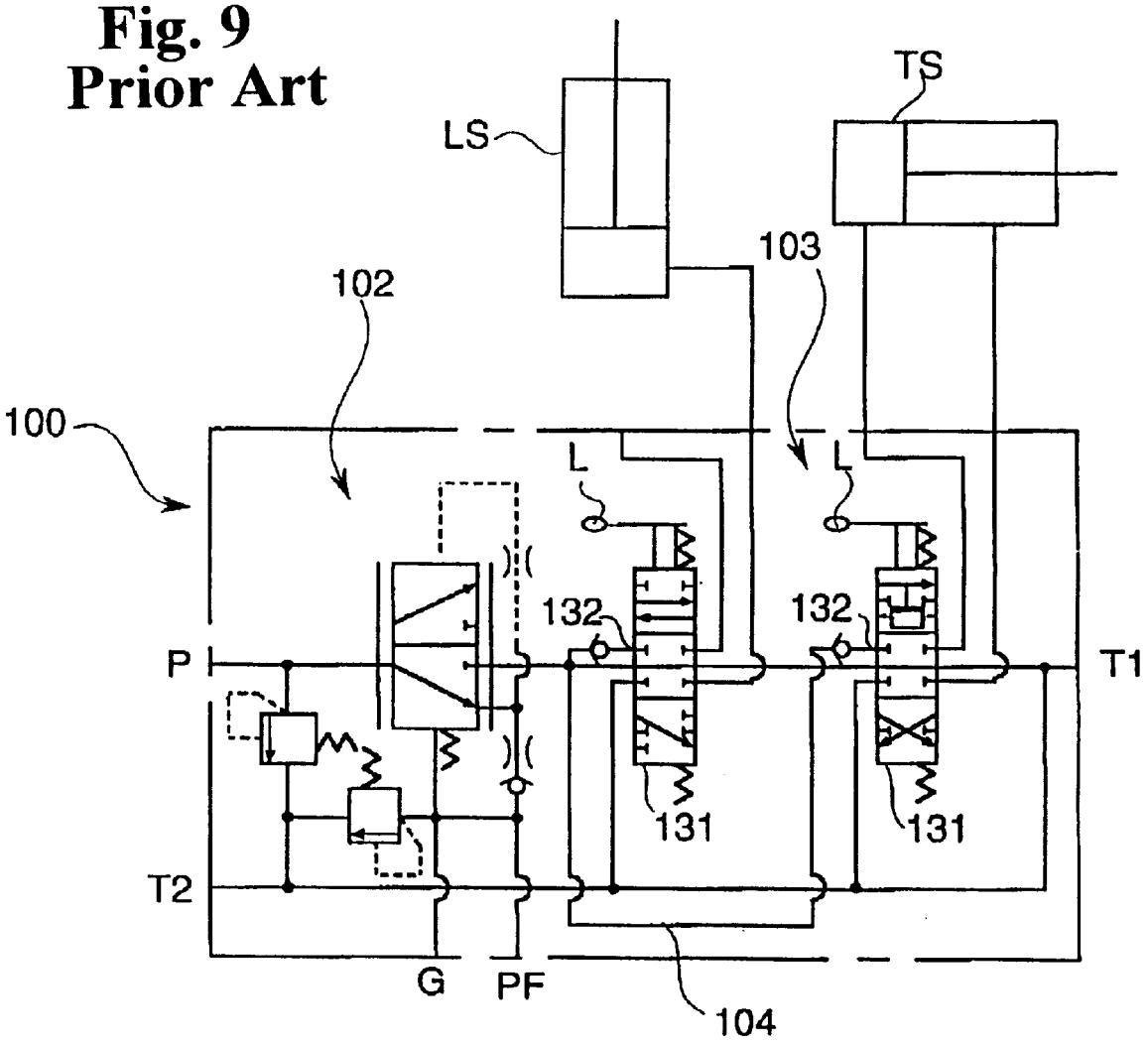
Fig. 9 Prior Art
FIG. 9 is a circuit diagram for oil pressure in the conventional multiple valve apparatus.

The second embodiment of the invention is shown in FIGS. 6 and 7, and has a structure similar to the first embodiment. However, in the second invention, an urgent valve block 6' includes therein a flow amount control valve 67 on a downstream of an urgent valve 61'.

Namely, as especially shown in FIGS. 6 and 7, the urgent valve block 6' is structured such that the urgent valve 61' and the flow amount control valve 67 at the downstream side of the urgent valve are integrally assembled into a manifold block 62' having hydraulic paths therein, and the urgent valve block 6' has an attachment compatibility with the switching valve mechanisms 3A and 3B. The urgent valve 61' is a balance piston valve in a pilot operating type, and is disposed on an unload path 63 which allows the hydraulic path constituting the tank line 5 to communicate with a hydraulic path constituting the parallel line 4 among the inner hydraulic paths in the urgent valve block 6'. And, the urgent valve 61' is opened when the electromagnetic valve 65 formed on the pilot path 64 is opened. The electromagnetic valve 65 is opened or closed by the output signals from the first and second detecting means. Also, at the unload path 63, the flow amount control valve 67 is disposed in a downstream side of the urgent valve 61'. As the flow amount control valve 67, there is used a flow amount control valve in a pressure compensating type having a characteristic of flowing a fixed flow amount without being greatly effected by a pressure.

The structure of an inner hydraulic circuit of the multiple valve apparatus 1' is almost the same as in the first embodiment. However, in the second embodiment, the parallel line 4 and the tank line 5 are connected through the unload path 63 formed in the urgent valve block 6', and when the urgent valve block 61 formed on the unload path 63 is opened, the parallel line 4 and the tank line are communicated with each other through the flow control valve 67.

Next, operations of the valve apparatus 1' will be explained. In case the lift cylinder LS is stretched or extended by the operation of the lift lever LL to thereby elevate the claw NL, an output signal of the second condition detecting means is switched when the claw NL reaches the predetermined height, so that the electromagnetic valve 65 is actuated to open and the urgent valve 61' is opened. As a result, the parallel line 4 is allowed to communicate with the tank line 5 through the flow amount control valve 67, and the operating oil supplied to the lift cylinder LS is unloaded. Thus, the elevating operation of the claw NL is automatically decelerated despite the elevating operation of the lift lever LL. Incidentally, a load check valve 33A is built in the switching valve mechanism 3A, so as to prevent the operating oil in the lift cylinder LS from flowing backward to lower the claw NL. As described above, the automatic decrease of elevation is achieved in the present embodiment.

On the other hand, while the tilt cylinder TS is being stretched or shrunk by the operation of the tilt lever TL to incline the mast MT in the front or rear direction, when the claw NL is located at an inclined position preliminary determined, the output signal of the first condition detecting means is switched, so that the electromagnetic valve 65 is actuated to open and the urgent valve 61' is opened. As a result, the parallel line 4 is allowed to communicate with the tank line 5 through the flow amount control valve 67, and the operating oil supplied to the tilt cylinder TS is unloaded. Thus, the inclination of the mast MT in the front or rear direction is automatically decelerated despite the operation of the tilt lever TL. Incidentally, a load check valve 33B is built in the switching valve mechanism 3B, so as to prevent the operating oil in the tilt cylinder TS from flowing backward to incline the mast MT. As described above, the automatic deceleration of the horizontal movement is achieved in the present embodiment.

Therefore, according to the multiple valve apparatus 1 or 1' as described above, without losing the function of the priority valve mechanism 2 as well as without using the high-grade and expensive member, such as an electromagnetic proportional valve, an automatic elevating stop or deceleration function, or automatic horizontal stop or deceleration function can be achieved by a very simple and inexpensive structure.

Especially, in the embodiments, the urgent stop valve 61 or the urgent valve 61' can be electromagnetically driven by the information from the condition detecting means. Thus, the urgent stop valve and the urgent valve can be further simplified.

Also, the urgent stop block 6 or urgent valve block 6' has the attachment compatibility with the switching valve mechanisms 3A and 3B, and can be stacked or attached between the switching valve mechanisms 3A and 3E or the respective ends thereof by simply attaching the urgent block 6 or 6' to the multiple valve apparatus 1 which has been already known or existing. Thus, the embodiments of the invention can be formed easily at an extremely low cost. As a result, there can be obtained various effects, such as encouraging the introduction of the apparatus to an user.

Incidentally, the present invention is not limited to the aforementioned embodiments. For example, although the urgent stop valve block is installed in the last part of the switching valve mechanisms in the aforementioned embodiment, even if the urgent valve block is installed or built in any positions, there can be achieved the same operation and effect. Also, it is needless to say that the present apparatus is not only adopted to the forklift truck, but also adopted to the various kinds of industrial vehicles. Further, the urgent valve can be attached to the priority valve mechanism, or the rear cover.

Furthermore, the present invention is not limited to the examples shown in the drawings, and can be modified variously within the gist of the invention.

As described above, according to the multiple valve apparatus of the present invention, without deteriorating the function of the priority valve mechanism as well as without adopting the high-grade and expensive member, such as the electromagnetic proportional valve, automatic stop function and automatic deceleration function, which are necessary for the forklift truck or the like, can be achieved by the extremely simple and inexpensive structure.

While the invention has been explained with reference to the specific embodiments of the invention, the explanation is illustrative and the invention is limited only by the appended claims.

What is claimed is:

1. A multiple valve apparatus comprising:

a priority valve mechanism for dividing an operating liquid into a priority flow and a surplus flow, and ejecting the same, at least one switching valve mechanism attached to the priority valve mechanism and having an input port, a parallel line for guiding the surplus flow discharged from the priority valve mechanism to the input port of the at least one switching valve mechanism, a tank line for discharging the operating liquid to a tank, and an urgent valve situated between the parallel line and the tank line, said urgent valve being operated in a predetermined condition to regulate an operation actuated by the surplus flow through the at least one switching valve mechanism.

2. A multiple valve apparatus according to claim 1, wherein said urgent valve allows the surplus flow in the parallel line to flow to the tank line.

3. A multiple valve apparatus according to claim 2, wherein said urgent valve is a valve to immediately completely eject the operating liquid in the parallel line to the tank line.

4. A multiple valve apparatus according to claim 3, further comprising a flow regulation valve situated in the parallel line between the urgent valve and tank line to reduce pressure of the surplus flow in the parallel line to the tank line.

5. A multiple valve apparatus according to claim 4, further comprising a load check valve situated in the parallel line communicating with the at least one switch valve mechanism to prevent a backward flow through the switch valve.

6. A multiple valve apparatus according to claim 3, wherein a plurality of switch valve mechanisms is attached to the parallel line.

7. A multiple valve apparatus according to claim 1, further comprising condition detecting means connected to the urgent valve for actuating the same.

8. A multiple valve apparatus according to claim 7, wherein said condition detecting means is a switch attached to a moving part of a vehicle to control a posture of the moving part.

* * * * *